US006363662B1

(12) United States Patent
Coates

(10) Patent No.: US 6,363,662 B1
(45) Date of Patent: Apr. 2, 2002

(54) COMBINED GUTTER GUARD AND CONCEALED DECORATIVE LIGHT STORAGE COMPARTMENT DEVICE

(76) Inventor: Joseph R. Coates, 5 Austin Rd., Marlton, NJ (US) 08053

( * ) Notice: Subject to any disclaimer, the term of this patent is extended or adjusted under 35 U.S.C. 154(b) by 0 days.

(21) Appl. No.: 09/596,888

(22) Filed: Jun. 20, 2000

(51) Int. Cl.[7] ..... E04F 19/00; E04D 13/076

(52) U.S. Cl. ..... 52/12; 52/28; 362/147

(58) Field of Search ..... 52/11, 12, 15, 52/27, 28; 362/145, 147, 151, 152, 149, 249, 219, 253

(56) References Cited

U.S. PATENT DOCUMENTS

| | | | | | |
|---|---|---|---|---|---|
| 3,388,555 | A | * | 6/1968 | Foster | 52/12 |
| 4,128,863 | A | | 12/1978 | Premetz | 362/249 |
| 4,631,875 | A | * | 12/1986 | Olson | 52/12 |
| 4,912,888 | A | * | 4/1990 | Martin | 52/12 |
| 5,404,279 | A | | 4/1995 | Wood | 362/145 |
| 5,510,966 | A | | 4/1996 | Konecny | 362/249 |
| 5,581,956 | A | * | 12/1996 | Fennessy et al. | 52/28 |
| 5,594,628 | A | | 1/1997 | Reuter et al. | 362/249 |
| 5,813,751 | A | | 9/1998 | Shaffer | 362/249 |

* cited by examiner

*Primary Examiner*—Michael Safavi

(57) ABSTRACT

A combined gutter guard and storage compartment device (10) for housing a string of decorative lights (300) adjacent the roof line (100) of a house (101) having a rain gutter (200). The device (10) includes a generally elongated rectangular gutter guard member (20) having a tapered proximal end (22) attached to the roof (100), an intermediate portion (23) provided with drainage slots (26) that communicates with the rain gutter (200) and a distal end (24) which overlies the end of the rain gutter (200). The distal end (24) also forms the roof portion (33) of a compartment member (30) dimensioned to receive a string of decorative lights (300). The compartment member (30) is further provided with a closure panel (34) having a latching arrangement (40) which can selectively dispose the closure panel (34) at either a fully closed or partially open disposition relative to the compartment member (30) to selectively expose the string of decorative lights (300).

20 Claims, 2 Drawing Sheets

COMBINED GUTTER GUARD AND CONCEALED DECORATIVE LIGHT STORAGE COMPARTMENT DEVICE

BACKGROUND OF THE INVENTION

1. Field of the Invention

The present invention relates to the field of decorative light storage compartments in general, and in particular to a storage compartment for decorative lights that also functions as a gutter guard.

2. Description of Related Art

As can be seen by reference to the following U.S. Pat. Nos. 4,128,863; 5,404,279; 5,510,966; 5,594,628, and 5,813,751, the prior art is replete with myriad and diverse storage compartments for decorative lights that are fixedly secured to the exterior of a home.

While all of the aforementioned prior art constructions are more than adequate for the basic purpose and function for which they have been specifically designed, they are uniformly deficient with respect to their failure to provide a simple, efficient, and practical decorative light storage compartment that also serves the dual function of a gutter guard that prevents debris from accumulating in rain gutters.

As anyone who has installed the prior art constructions is all too well aware, they work fine as designed; however, they do not provide any additional benefit for the homeowner other than fulfilling their originally intended purpose and function.

As a consequence of the foregoing situation, there has existed a longstanding need among homeowners for a new and improved permanently installed decorative light storage compartment that will also function as a gutter guard given the normal installation of the other light storage compartments at or near the roof line of a home, and the provision of such a construction is the stated objective of the present invention.

BRIEF SUMMARY OF THE INVENTION

Briefly stated, the combined device that forms the basis of the present invention comprises in general, a gutter guard unit and a storage compartment unit. Each of these units in the preferred embodiment are formed integrally with one another and have at least one co-extensive portion or surface.

The gutter guard unit comprises a generally flat elongated gutter guard member having one tapered end that is adapted to be secured to roof surfaces either by virtue of conventional fasteners or by having the tapered edge wedged under a row of roof shingles.

In addition, the gutter guard member has an intermediate portion that is provided with a plurality of elongated drainage slots that permit water to drain into a rain gutter while preventing debris from being deposited within the rain gutter, and a second distal end that overlies the outer edge of the rain gutter and constitutes the roof panel of the storage compartment unit.

The storage compartment unit comprises in general, a storage compartment member having a rear wall panel and a floor panel that are suspended from the distal end of the gutter guard member and a closure panel that is pivotally connected to the outer edge of the gutter guard member to form an enclosure for a string of decorative lights. The front end of the floor panel rests on and is releasably engaged with the outer lip of the rain gutter.

Furthermore, the storage compartment member is further provided with a unique latching arrangement that is operatively associated with both the floor panel and the closure panel. The closure panel may be disposed in a completely closed mode to conceal and protect the string of decorative lights or disposed in a partially open mode to reveal the decorative lights while still protecting the lights from inclement weather and preventing the entrance of debris into the interior of the enclosure.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
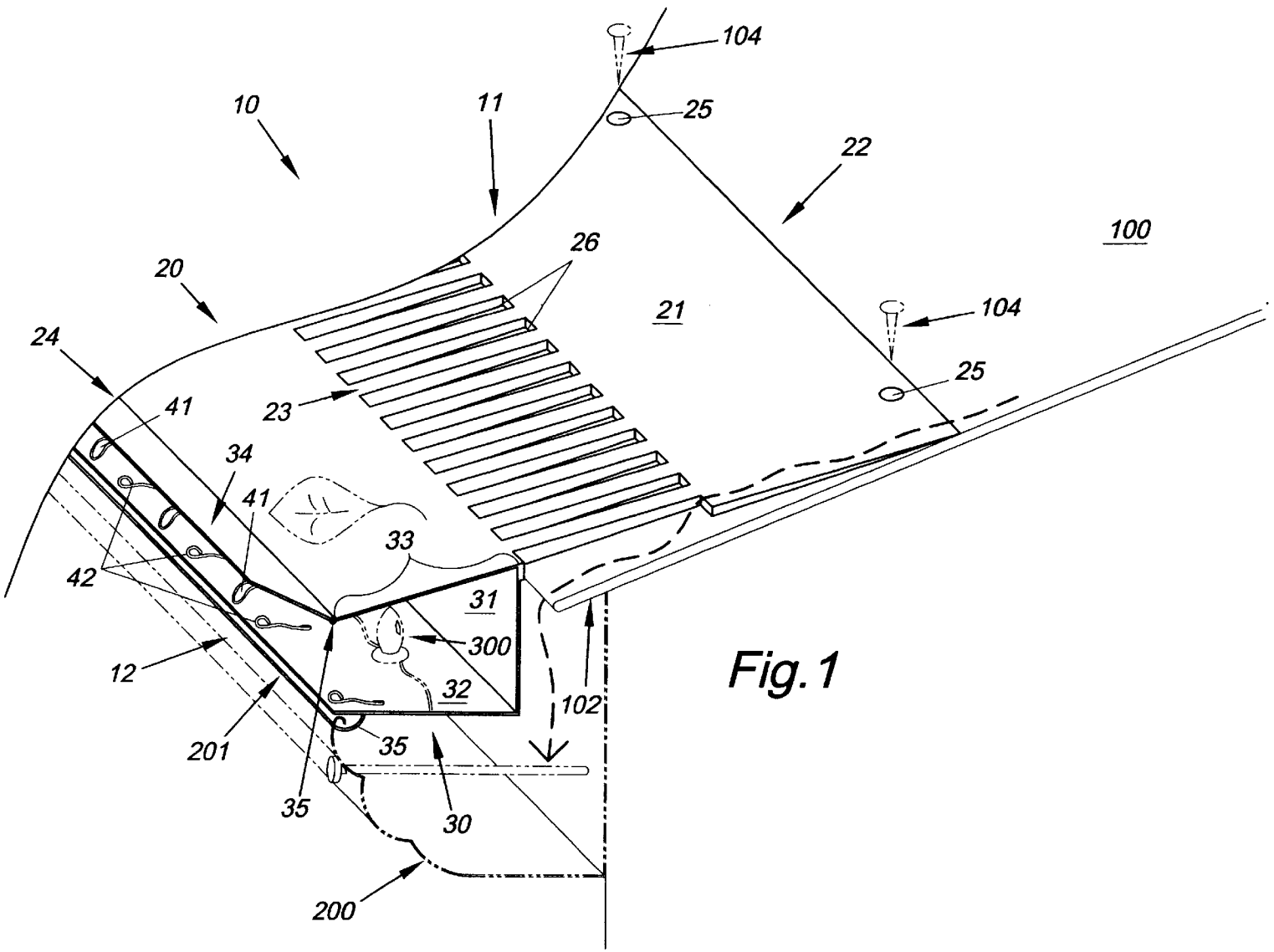
FIG. 1 is a partial cut away perspective view of the combined device that forms the basis of the present invention installed along the eave line of a roof.

As can be seen by reference to the drawings, and in particular to FIG. 1, the combined device that forms the basis of the present invention is designated generally by the reference number 10. The device 10 comprises in general a gutter guard unit 11, and a storage compartment unit 12. These units will now be described in seriatim fashion.

Figures 2, 3:
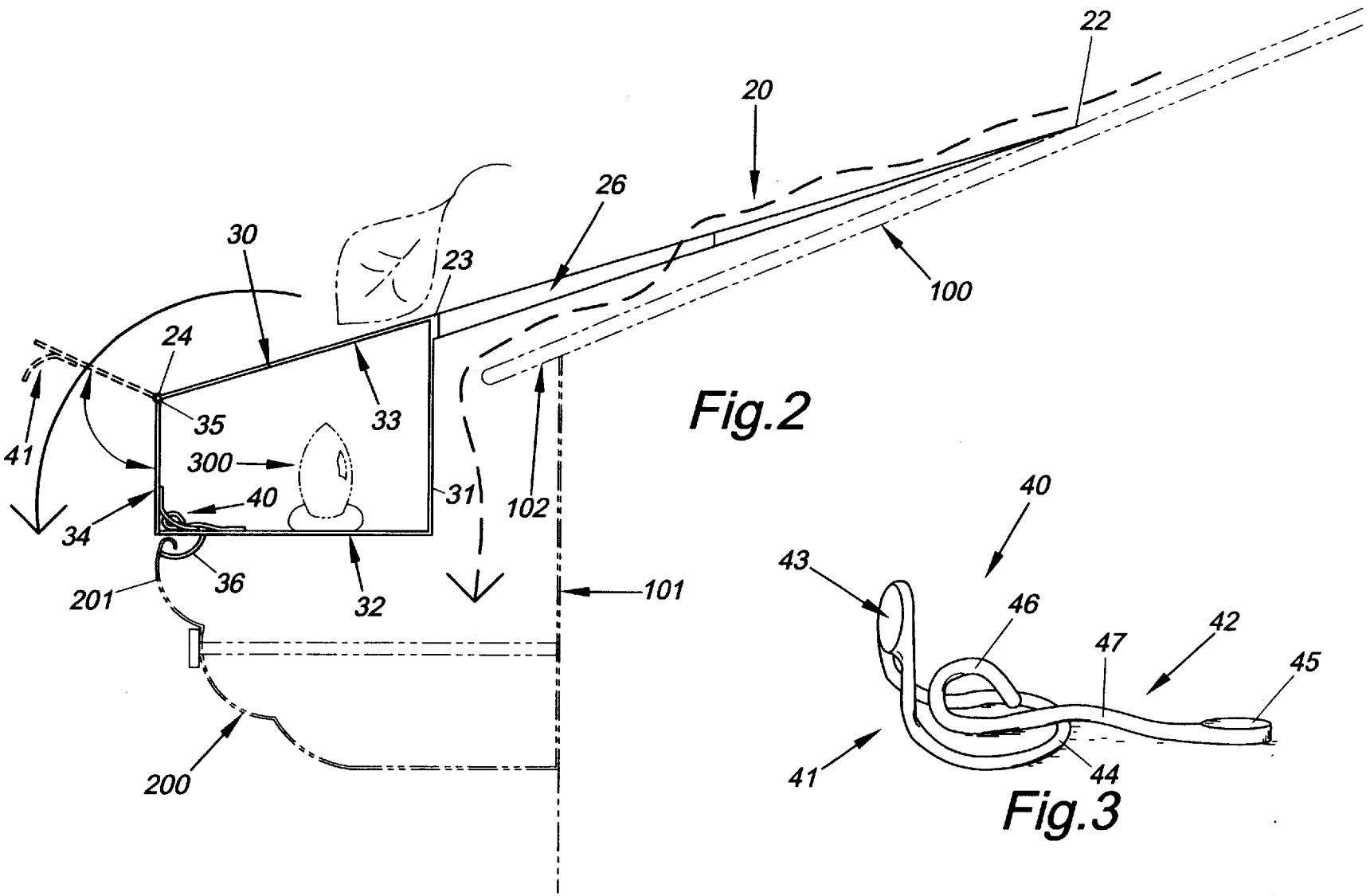
FIG. 2 is a side elevation cross sectional view similar to FIG. 1.
FIG. 3 is an isolated perspective view of the latching mechanism that controls the partial opening of the storage compartment unit.

As shown in FIGS. 1 and 2, the gutter guard unit 11 comprises a gutter guard member 20 including an elongated rectangular sheet of material 21 having a tapered proximal end 22, a thickened intermediate portion 23, and a relatively thin uniform thickness distal end 24. The tapered proximal end 22 is provided with a plurality of spaced apertures 25 and the thickened intermediate portion 23 is provided with a plurality of closely spaced elongated drain slots 26.

Still referring to FIGS. 1 and 2, it can be seen that the compartment unit 12 comprises an elongated compartment member 30 having a rear wall panel 31 that is formed integrally with, and depends downwardly from the thickened intermediate portion 23 of the gutter guard member 20 and a floor panel 32 formed integrally with the rear wall panel 31. The rear wall panel 31 and the floor panel 32 are disposed perpendicular to one another.

As can best be appreciated by reference to FIG. 2, the generally thin uniform thickness distal end 24 of the gutter guard member 20 constitutes the downwardly angled roof panel 33 of the compartment member 30. The compartment closure panel 34 is pivotally suspended as at 35 from the distal end 24 of the gutter guard member 20. In addition, the floor panel 32 of the compartment member 30 is further provided with a downwardly and outwardly curved catch element 36 whose purpose and function will be described.

As can best be appreciated by reference to FIGS. 1 and 2, the tapered proximal end 22 of the gutter guard member 20 is adapted to be fixedly secured to the roof 100 of a house having a rain gutter 200 disposed beneath the eave 102 of the roof line. The distal end 24 of the gutter guard member 20 will extend outwardly at least to the outer edge of the rain gutter 200.

In addition, the apertures 25 on the tapered proximal end 22 of the rain gutter guard 20 are dimensioned to receive conventional fastening elements 104 for fixedly securing the gutter guard member 20 to the roof 100 in a well recognized fashion. The outer edge of the floor panel 32 of the compartment member 30 is designed to rest on top of the outer lip 201 of the rain gutter while the curved catch element 36 on the bottom of the floor panel 32 engages the underside of the inwardly curved lip 201 of the rain gutter to maintain the combined device 10 in place relative to roof 100 and gutter 200.

Turning now to FIGS. 1 through 3, it can be seen that the compartment member 30 is further provided with a latch arrangement designated generally as 40 and including a plurality of curved loop shaped latching components 41 disposed at spaced locations along the closure panel 34 and a plurality of generally P-shaped latching components 42 disposed at spaced locations on the floor panel 32 of the compartment member 30.

As can best be appreciated by reference to FIG. 3, each of the loop shaped latching components 41 have a single point of attachment 43 formed on the upper end. The remainder of the loop configuration extends downwardly and rearwardly from the point of attachment such that the free end 44 of the loop configuration is disposed in a plane generally perpendicular to the plane of the point of attachment 43.

In addition, each of the generally P-shaped latching components 42 have a fixed end 45, a looped free end 46 and a curved intermediate stem portion 47 whose purposes and functions will be described presently.

Given the fact that the P-shaped latching components have an elongated curved intermediate portion 47, the looped free end 46 of that component can be flexibly deformed relative to the floor panel 32 such that the curved intermediate portion 47 of the P-shaped latching component 42 can captively engage the free end 44 of the looped latching component 41 as depicted in FIGS. 2 and 3.

However, as was mentioned previously in the specification, the latching arrangement 40 is also designed to allow the closure panel 34 to be disposed in a partially open position so that the string of lights 300 are visible within the interior of the compartment member 30 without totally exposing the interior of the compartment member 30 and the string of decorative lights to inclement weather conditions.

In this particular mode of deployment, the free end 44 of the loop shaped latching component 41 is released from captive engagement beneath the curved intermediate stem portion 47 of the P-shaped latching component 42 and allowed to rest against the free end 46 thereof to maintain the closure panel 34 in a partially open disposition.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A combined gutter guard and storage compartment device for housing a string of decorative lights adjacent the roof line of a house having a rain gutter wherein the combined device comprises:

a gutter guard unit including a generally elongated rectangular gutter guard member having a proximal end adapted to be fixedly secured to the roof surface, a distal end dimensioned to overlie the outer end of the rain gutter, and an intermediate portion provided with a plurality of elongated drain slots that are adapted to be in open communication with the rain gutter; and a compartment unit including a compartment member depending downwardly from said intermediate portion of the gutter guard member and having a floor panel wherein the floor panel has a front portion that is adapted to rest on the outer lip of the rain gutter wherein the compartment member has a rear wall panel that projects upwardly from the floor panel and is fixedly secured to the underside of the gutter guard member and wherein the compartment member is further provided with a pivoted closure panel.

2. The combined device as in claim 1 wherein said rear wall panel and the floor panel are formed integrally with one another.

3. The combined device as in claim 2 wherein said rear wall panel is formed integrally with the gutter guard member.

4. The combined device as in claim 1 wherein the closure panel is pivotally suspended from the distal end of the gutter guard member.

5. The combined device as in claim 4 wherein the compartment member is further provided with a roof panel that is associated with the distal end of the gutter guard member.

6. The combined device as in claim 5 wherein the roof panel of the compartment member and the distal end of the gutter guard member are disposed coextensive with one another.

7. The combined device as in claim 5 wherein the roof panel of the compartment member and the distal end of the gutter guard member are formed integrally with one another.

8. The combined device as in claim 1 wherein said floor panel is further provided with a downwardly and outwardly curved catch element that is adapted to engage the outer lip of the rain gutter.

9. The combined device as in claim 1 wherein the proximal end of the gutter guard member has a tapered configuration.

10. The combined device as in claim 9 wherein the intermediate portion of the gutter guard member has a thickened configuration.

11. The combined device as in claim 10 wherein the distal end of the gutter guard member has a generally uniform thickness thin configuration.

12. The combined device as in claim 1 wherein the compartment member further comprises:

means for selectively maintaining said closure panel in a partially open disposition or a fully closed disposition.

13. The combined device as in claim 1 wherein the compartment member further includes a latch arrangement including a plurality of first latch components disposed at spaced locations on the closure panel and a plurality of second latch components disposed at spaced locations on the floor panel.

14. The combined device as in claim 13 wherein one of said first and second latch components comprises a plurality of generally P-shaped latch components each having a fixed end, a looped free end, and a curved intermediate stem portion.

15. The combined device as in claim 14 wherein the other of said first and second latch components comprises a plurality of loop shaped latch components each having a single point of attachment formed on one end and a free end that is disposed generally perpendicular to said one end.

16. A combined gutter guard and storage compartment device for housing a string of decorative lights adjacent the roof line of a house having a rain gutter wherein the combined device comprises:

a gutter guard unit including a generally elongated rectangular gutter guard member having a proximal end adapted to be fixedly secured to the roof surface, a distal end dimensioned to overlie the outer end of the rain gutter, and an intermediate portion provided with a plurality of elongated drain slots that are adapted to be in open communication with the rain gutter; and a compartment unit including a compartment member depending downwardly from said intermediate portion of the gutter guard member and having a floor panel wherein the floor panel has a front portion that is adapted to rest on the outer lip of the rain gutter; and wherein said floor panel is further provided with a downwardly and outwardly curved catch element that is adapted to engage the outer lip of the rain gutter.

17. The combined device as in claim 16 wherein the compartment member is further provided with a pivoted closure panel.

18. A combined gutter guard and storage compartment device for housing a string of decorative lights adjacent the roof line of a house having a rain gutter wherein the combined device comprises:

a gutter guard unit including a generally elongated rectangular gutter guard member having a tapered proximal end adapted to be fixedly secured to the roof surface, a distal end dimensioned to overlie the outer end of the rain gutter, and an intermediate portion provided with a plurality of elongated drain slots that are adapted to be in open communication with the rain gutter; and a compartment unit including a compartment member depending downwardly from said intermediate portion of the gutter guard member and having a floor panel wherein the floor panel has a front portion that is adapted to rest on the outer lip of the rain gutter.

19. The combined device as in claim 18 wherein the compartment member is further provided with a pivoted closure panel.

20. The combined device as in claim 19 wherein the closure panel is pivotally suspended from the distal end of the gutter guard member.

* * * * *